US009488046B2

(12) United States Patent
Purkis

(10) Patent No.: US 9,488,046 B2
(45) Date of Patent: Nov. 8, 2016

(54) APPARATUS AND METHOD FOR DOWNHOLE COMMUNICATION

(75) Inventor: Daniel Purkis, Peterhead (GB)

(73) Assignee: Petrowell Limited, Aberdeen (GB)

( * ) Notice: Subject to any disclaimer, the term of this patent is extended or adjusted under 35 U.S.C. 154(b) by 1091 days.

(21) Appl. No.: 13/389,630

(22) PCT Filed: Aug. 23, 2010

(86) PCT No.: PCT/GB2010/051389
§ 371 (c)(1),
(2), (4) Date: Feb. 29, 2012

(87) PCT Pub. No.: WO2011/021053
PCT Pub. Date: Feb. 24, 2011

(65) Prior Publication Data

US 2012/0146806 A1 Jun. 14, 2012

(30) Foreign Application Priority Data

Aug. 21, 2009 (GB) ..... 0914650.7

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC ..... E21B 47/09
USPC ..... 340/853.1, 853.3
See application file for complete search history.

(56) References Cited

U.S. PATENT DOCUMENTS 3,227,228 A 1/1966 Bannister
3,233,674 A 2/1966 Leutwyler
(Continued)

FOREIGN PATENT DOCUMENTS

EP 1214501 B1 4/2005
GB 2420133 A * 5/2006
(Continued)

OTHER PUBLICATIONS

Fraley, Karen, et al., "RFID Technology for Downhole Well Applications," Exploration & Production—Oil & Gas Review 2007—OTC Edition, 3 pages.
(Continued)

*Primary Examiner* — Amine Benlagsir
(74) *Attorney, Agent, or Firm* — Winstead PC

(57) ABSTRACT

A method for downhole communication and an apparatus for remote actuation of a downhole tool is disclosed. The method comprises the steps of: programming at least one tag (20) to emit a radio frequency identification signal in the form of a frequency change in a carrier wave; locating a reader (10) responsive to signals emitted from the at least one tag downhole; moving the at least one tag (20) past the downhole reader (10) such that the downhole reader (10) is capable of reading data from the tag (20) when the tag (20) passes the reader (10); and thereby communicating data from the tag (20) to the reader (10) downhole. Typically, the method includes programming the tag (20) and the reader (10) to communicate data by at least one of the following means: transitions between discrete frequencies; use of specific discrete frequencies; and length of time in which a carrier wave emits a specific frequency in preference to at least one other frequency.

29 Claims, 2 Drawing Sheets

(56) References Cited

U.S. PATENT DOCUMENTS 3,914,732 A 10/1975 Brumleve et al.
4,432,417 A 2/1984 Bowyer
4,617,960 A 10/1986 More
4,698,631 A 10/1987 Kelly, Jr. et al.
4,712,613 A 12/1987 Nieuwstad
4,796,699 A 1/1989 Upchurch
4,856,595 A 8/1989 Upchurch
4,896,722 A 1/1990 Upchurch
4,915,168 A 4/1990 Upchurch
5,142,128 A 8/1992 Perkin et al.
5,146,983 A 9/1992 Hromas et al.
5,203,414 A 4/1993 Hromas et al.
5,226,494 A 7/1993 Rubbo et al.
5,289,372 A 2/1994 Guthrie et al.
5,343,963 A 9/1994 Bouldin et al.
5,360,967 A 11/1994 Perkin et al.
5,558,153 A 9/1996 Holcombe et al.
5,579,283 A 11/1996 Owens et al.
5,611,401 A 3/1997 Myers, Jr. et al.
5,706,896 A 1/1998 Tubel et al.
5,893,413 A 4/1999 Lembcke et al.
5,991,602 A * 11/1999 Sturm ..... H04B 13/00 455/40
6,012,518 A 1/2000 Pringle et al.
6,021,095 A 2/2000 Tubel et al.
6,055,213 A 4/2000 Rubbo et al.
6,109,357 A 8/2000 Zimmerman
6,244,351 B1 6/2001 Patel et al.
6,308,137 B1 10/2001 Underhill et al.
6,333,699 B1 12/2001 Zierolf
6,333,700 B1 12/2001 Thomeer et al.
6,343,649 B1 2/2002 Beck et al.
6,347,292 B1 2/2002 Denny et al.
6,349,772 B2 2/2002 Mullen et al.
6,359,569 B2 3/2002 Beck et al.
6,384,738 B1 5/2002 Carstensen et al.
6,388,577 B1 5/2002 Carstensen
6,414,905 B1 7/2002 Owens et al.
6,443,228 B1 9/2002 Aronstam et al.
6,480,811 B2 11/2002 Denny et al.
6,481,505 B2 11/2002 Beck et al.
6,488,082 B2 12/2002 Echols et al.
6,497,280 B2 12/2002 Beck et al.
6,536,524 B1 3/2003 Snider
6,588,505 B2 7/2003 Beck et al.
6,597,175 B1 7/2003 Brisco
6,604,063 B2 8/2003 Denny et al.
6,624,759 B2 9/2003 Tubel et al.
6,684,953 B2 2/2004 Sonnier
6,710,720 B2 3/2004 Carstensen et al.
6,745,833 B2 6/2004 Aronstam et al.
6,759,968 B2 7/2004 Zierolf
6,760,275 B2 7/2004 Carstensen
6,776,240 B2 8/2004 Kenison et al.
6,782,948 B2 8/2004 Echols et al.
6,789,619 B2 9/2004 Carlson et al.
6,802,373 B2 10/2004 Dillenbeck et al.
6,915,848 B2 7/2005 Thomeer et al.
6,935,425 B2 8/2005 Aronstam
6,973,416 B2 12/2005 Denny et al.
6,976,535 B2 12/2005 Aronstam et al.
6,989,764 B2 1/2006 Thomeer et al.
7,014,100 B2 3/2006 Zierolf
7,025,146 B2 4/2006 King et al.
7,044,229 B2 5/2006 Tennoy et al.
7,062,413 B2 6/2006 Denny et al.
7,063,148 B2 6/2006 Jabusch
7,066,256 B2 6/2006 Dillenbeck et al.
7,084,769 B2 8/2006 Bauer et al.
7,128,154 B2 10/2006 Giroux et al.
7,159,654 B2 1/2007 Ellison et al.
RE39,583 E 4/2007 Upchurch
7,201,231 B2 4/2007 Chaplin et al.
7,252,152 B2 8/2007 LoGiudice et al.
7,273,102 B2 9/2007 Sheffield
7,275,602 B2 10/2007 Green et al.
7,283,061 B1 10/2007 Snider et al.
7,295,491 B2 11/2007 Carstensen
7,296,462 B2 11/2007 Gregory et al.
7,322,410 B2 1/2008 Vinegar et al.
7,337,850 B2 3/2008 Contant
7,385,523 B2 6/2008 Thomeer et al.
7,389,205 B2 6/2008 Denny et al.
7,400,263 B2 7/2008 Snider et al.
7,455,108 B2 11/2008 Jenkins et al.
7,484,625 B2 2/2009 Scott et al.
7,500,389 B2 3/2009 Green et al.
7,503,398 B2 3/2009 LoGiudice et al.
7,510,001 B2 3/2009 Spring et al.
7,543,637 B2 6/2009 Green et al.
7,562,712 B2 7/2009 Cho et al.
7,588,100 B2 9/2009 Hamilton
7,591,318 B2 9/2009 Tilghman
7,606,682 B2 10/2009 Denny et al.
7,634,942 B2 12/2009 Green et al.
7,665,527 B2 2/2010 Loretz
7,714,741 B2 5/2010 Snider et al.
7,912,678 B2 3/2011 Denny et al.
7,946,356 B2 5/2011 Koederitz et al.
7,958,715 B2 6/2011 Kinert et al.
7,963,452 B2 6/2011 Moritz
8,016,037 B2 9/2011 Bloom et al.
2003/0029611 A1 2/2003 Owens
2003/0174099 A1 9/2003 Bauer et al.
2004/0239521 A1 12/2004 Zierolf
2005/0115708 A1* 6/2005 Jabusch ..... E21B 47/122 166/250.15
2005/0230109 A1 10/2005 Kammann et al.
2005/0285645 A1* 12/2005 Hall ..... H03K 23/52 327/165
2005/0285751 A1* 12/2005 Hall ..... E21B 47/12 340/853.1
2006/0087448 A1 4/2006 Den Boer et al.
2006/0100968 A1* 5/2006 Hall ..... E21B 41/0085 705/400
2006/0113803 A1* 6/2006 Hall ..... E21B 41/0085 290/54
2006/0124310 A1 6/2006 Lopez de Cardenas et al.
2006/0175404 A1 8/2006 Zierolf
2006/0202835 A1 9/2006 Thibault
2006/0243643 A1* 11/2006 Scott ..... B01D 33/0376 209/309
2006/0250243 A1 11/2006 Masino et al.
2006/0267770 A1 11/2006 Sanari et al.
2007/0124220 A1 5/2007 Griggs et al.
2007/0267221 A1 11/2007 Giroux et al.
2007/0272411 A1 11/2007 Lopez De Cardenas et al.
2007/0285275 A1 12/2007 Purkis et al.
2008/0000690 A1 1/2008 Lynde
2008/0019216 A1* 1/2008 Leggett, III ..... G01V 1/44 367/25
2008/0041597 A1 2/2008 Fisher et al.
2008/0074282 A1* 3/2008 Koo ..... H04B 1/408 340/13.26
2008/0105427 A1 5/2008 Hampton et al.
2008/0128126 A1 6/2008 Dagenais et al.
2008/0128168 A1 6/2008 Purkis et al.
2008/0149345 A1 6/2008 Marya et al.
2008/0245534 A1 10/2008 Purkis
2008/0271887 A1 11/2008 Snider et al.
2009/0027166 A1* 1/2009 Stevens ..... G06K 19/07749 340/10.1
2009/0034368 A1* 2/2009 Johnson ..... E21B 47/14 367/83
2009/0044937 A1 2/2009 Purkis
2009/0065214 A1 3/2009 Purkis
2009/0090502 A1 4/2009 Lumbye et al.
2009/0114401 A1 5/2009 Purkis
2009/0121895 A1 5/2009 Denny et al.
2009/0151939 A1 6/2009 Bailey et al.
2009/0208295 A1 8/2009 Kinert et al.
2009/0223663 A1 9/2009 Snider et al.
2009/0223670 A1 9/2009 Snider
2009/0230340 A1 9/2009 Purkis

(56) References Cited

U.S. PATENT DOCUMENTS

| | | | | |
|---|---|---|---|---|
| 2009/0266544 | A1 | 10/2009 | Redlinger et al. | |
| 2009/0272544 | A1 | 11/2009 | Giroux et al. | |
| 2009/0283454 | A1 | 11/2009 | Scott et al. | |
| 2010/0044034 | A1 | 2/2010 | Bailey et al. | |
| 2010/0089583 | A1 | 4/2010 | Xu et al. | |
| 2010/0170681 | A1 | 7/2010 | Purkis | |
| 2010/0200243 | A1 | 8/2010 | Purkis | |
| 2010/0200244 | A1 | 8/2010 | Purkis | |
| 2011/0001633 | A1* | 1/2011 | Lam | G01R 29/26 340/853.1 |
| 2011/0148603 | A1 | 6/2011 | Denny et al. | |
| 2011/0204143 | A1 | 8/2011 | Mackenzie et al. | |
| 2011/0248566 | A1 | 10/2011 | Purkis | |
| 2012/0065126 | A1 | 3/2012 | Bruser et al. | |
| 2012/0206243 | A1* | 8/2012 | Butler | G06K 7/0008 340/10.51 |

FOREIGN PATENT DOCUMENTS

| | | | |
|---|---|---|---|
| GB | 2420133 | A | 5/2006 |
| WO | 9205533 | A1 | 4/1992 |
| WO | 00/73625 | A1 | 12/2000 |
| WO | 2006046075 | A2 | 5/2006 |
| WO | 2006051250 | A1 | 5/2006 |
| WO | 2006082407 | A1 | 8/2006 |
| WO | 2006082421 | A1 | 8/2006 |
| WO | 2006109008 | A1 | 10/2006 |
| WO | 2006120466 | A2 | 11/2006 |
| WO | 2007125335 | A1 | 11/2007 |
| WO | 2008059260 | A2 | 5/2008 |
| WO | 2009/050518 | A2 | 4/2009 |
| WO | 2009050517 | A2 | 4/2009 |
| WO | WO-2009/050518 | A2 | 4/2009 |
| WO | 2009098512 | A2 | 8/2009 |
| WO | 2009109788 | A1 | 9/2009 |
| WO | 2009114356 | A1 | 9/2009 |
| WO | 2010038072 | A1 | 4/2010 |
| WO | 2010086654 | A1 | 8/2010 |
| WO | 2010149643 | A1 | 12/2010 |
| WO | 2010149644 | A1 | 12/2010 |
| WO | WO-2012065123 | A2 | 5/2012 |
| WO | WO-2012065126 | A2 | 5/2012 |

OTHER PUBLICATIONS

Snider, Philip M., et al., "AADE 2009NTCE-16-04: RFID Downhole Tools and Development for the Drilling Environment," AADE 2009 National Technical Conference & Exhibition, New Orleans, Louisiana, 2009NTCE-16-04 Tech Paper, pp. 1-3.

Runge, Paul, "Petrowell Operations Report," Petrowell RFID Circulation Sub First Deployment for CNR International, Aug. 25, 2005, 11 pages.

*Hubertus* v. *Thomeer, et al*. v. *Snider, et al*., Patent Interference No. 105,466 (SCM) (Technology Center 2600), Before the Board of Patent Appeals and Interferences, Entered Nov. 21, 2006, 3 pages.

M-1 Swaco, Company News, JPT, May 2008, 1 page.

Ott, Stephane, "International Search Report" for PCT/GB2010/051389, as mailed May 6, 2011, 3 pages.

* cited by examiner

APPARATUS AND METHOD FOR DOWNHOLE COMMUNICATION

The present invention relates to a method for downhole communication and an apparatus for remote actuation of a downhole tool. In particular, but not exclusively, the invention relates to a method for downhole communication with, and an apparatus for actuation of, tools in an oil or gas well.

Radio frequency identification (hereinafter RFID) provides a useful method for communicating with downhole tools and devices. One arrangement for remote operation of circulation subs using RFID is described in GB Patent No 2420133B, the entire disclosure of which is incorporated herein by reference.

The most commonly used method of transmitting data using RFID makes use of a signal modulation system known as amplitude shift keying (hereinafter ASK). ASK is a form of signal modulation that represents digital data as variations in the amplitude of a carrier wave having a constant frequency and phase. The overwhelming majority of RFID systems and commercially available RFID tags use ASK as it is generally the cheapest, most well known and readily available system for transmitting data using RFID.

In view of the ease of availability of RFID tags programmed to transmit signals using ASK as well as the generally accepted view that ASK functions well in a metal environment, RFID communication using ASK is typically considered the preferred method for downhole communication in oil and gas wells.

According to the present invention there is provided a method of downhole communication comprising the steps of:—

(a) programming at least one tag to emit a radio frequency identification signal in the form of a frequency change in a carrier wave;

(b) locating a reader responsive to signals emitted from the at least one tag downhole;

(c) moving the at least one tag past the downhole reader such that the downhole reader is capable of reading data from the tag when the tag passes the reader; and (d) thereby communicating data from the tag to the reader downhole.

"Downhole" as used herein is intended to refer to a volume defined by a wellbore, such as an open hole or a cased/completed wellbore.

The method can include programming the tag and the reader to communicate data by at least one of the following means: transitions between discrete frequencies; use of specific discrete frequencies; and length of time in which a carrier wave emits a specific frequency in preference to at least one other frequency.

Step (a) can include programming the tag with a radio frequency identification signal in the form of a carrier wave having at least two different frequencies. Step (a) can include programming the tag with a radio frequency identification signal in the form of a carrier wave having two different frequencies.

The method of communication can include programming the tag to emit a radio frequency identification signal in the form of a carrier wave having two discrete frequencies, wherein the two discrete frequencies transmit binary information to the downhole reader.

The method can include selecting a carrier wave having at least two discrete frequencies that are in the frequency range between 10 kilohertz and 200 kilohertz.

More preferably, the at least two frequencies forming the signal can be selected in the frequency range between 100 and 150 kilohertz. Even more preferably, the frequencies of the carrier wave forming the signal can be selected in the frequency range 120 to 140 kilohertz. Most preferably, the frequencies can be selected in the frequency range 124 to 136 kilohertz.

Step (a) can include selecting a carrier wave having two discrete frequencies: 124 kilohertz; and 134 kilohertz.

The method can include spacing the discrete frequencies by a minimum quantity. As a result, the change in the discrete frequencies of the carrier wave can be more easily identifiable by the downhole reader in a variety of downhole conditions.

For example, the minimum frequency difference between two signals can be greater than 2 kilohertz (kHz), for example, frequencies of 128 and 132 kHz, separated by 4 kHz. The minimum difference between the frequencies can be at least 5 kilohertz, for example, frequencies of 127 and 134 kHz, separated by 7 kHz. Most preferably, the minimum difference between the frequencies can be at least 8 kilohertz, for example, frequencies of 124 and 134 kHz, separated by 10 kHz. This can ensure that the at least two discrete frequencies are sufficiently distinguishable from one another by the downhole reader.

The method can also include maintaining a constant amplitude of the carrier wave.

Prior to step (b), the method can include programming the reader to transmit data to the at least one tag via a radio frequency identification signal in the form of a discrete frequency change in a carrier wave. Data transferred from the reader to the at least one tag can include operating conditions of a coupled tool or external environment.

Step (b) can include associating the reader with a conduit downhole for the passage of fluids therethrough. This step can include arranging the reader such that downhole fluids and the at least one tag can pass through a throughbore of the downhole conduit and reader.

The conduit can comprise any downhole tubing string such as a drillstring or production string. The method may further comprise the step of matching the inner diameter of the reader and the conduit such that the inner diameter of the conduit is not restricted by the reader.

Step (c) can also include running the at least one tag downhole.

The method can include circulating fluid through the conduit and the reader. The method of step (c) can include adding the at least one tag to the circulating fluid. This step can include circulating the tag through the reader Step (c) can include charging the at least one tag as it is moved past the reader. Charging the tag can thereby cause the tag to emit the radio frequency identification signal.

The method may comprise the additional step of recovering the tag after use.

The method for downhole communication can include communicating data from the tag to the downhole reader for the purpose of actuating a downhole tool.

Prior to step (d), the method can include associating a downhole tool with the reader to enable remote actuation of the downhole tool.

The downhole tool can be selected from the group consisting of: sliding sleeves; packers; flapper valves; and other tools located in a tubing string.

The method can include locating at least two readers downhole with associated tools, the readers being individually identifiable or selectable. The tags may be selectively programmed with unique data, for example, specific discrete frequencies, such that data from each tag is capable of being received by an individual reader responsive to the specific discrete frequencies. Therefore, there may be provided several readers coupled to respective downhole tools and a plurality of tags selectively encoded with data which may be read only by a particular reader with a unique identity, for operation of a specific tool.

The reader can be an antenna. The antenna can be less then 10 meters in axial length, for example, between 5-10 meters. The antenna can be less then 5 meters in axial length, for example between 2 to 5 meters.

Alternatively and preferably, the antenna can be around 0.5 meter in axial length, for example, between 0.1 to 1 meters and most preferably, the antenna is around 14 inches (0.356 meters) in axial length.

The antenna can comprise a generally cylindrical housing and a coiled conductor within a portion of the housing, wherein the coiled conductor is separated from the portion of housing by an insulating material, and wherein the portion of the housing has a greater internal diameter than an external diameter of the coiled conductor. The insulating material can be any suitable non-conducting material such as air, glass fibre, rubber or ceramic.

The antenna can further comprise a liner, wherein the coiled conductor is wrapped around the liner, in a helical co-axial manner. Preferably, the housing and liner form a seal around the coiled conductor and insulating material. The housing can be made of steel. The liner can be non-magnetic and non-conductive to restrict eddy currents.

Since the antenna is provided for use downhole, all components comprising the antenna can be capable of withstanding the high temperatures and pressures experienced downhole.

According to a second aspect of the invention, there is also provided apparatus for actuating a downhole tool comprising:

at least one tag programmed to emit a radio frequency identification signal in the form of a frequency change of a carrier wave; and a downhole tool coupled to a downhole reader responsive to a signal emitted by the at least one tag for actuation of the downhole tool.

According to a third aspect of the invention there is provided a downhole tag programmed to emit a radio frequency identification signal in the form of a frequency change in a carrier wave.

The tag is preferably adapted to withstand the temperatures and pressures experienced downhole. The tag can be oil-filled to improve its collapse rating.

All optional or essential features or steps of the first aspect of the invention can be provided in conjunction with the features of the second or third aspects of the invention where appropriate.

Embodiments of the invention will now be described, by way of example only, with reference to the accompanying drawings, in which:—

FIG. 1(*b*) shows a sub optimum orientation of the tag as it travels in the fluid flow of a downhole conduit in the direction of the flow indicated by the arrow;

FIG. 1(*c*) is an undesirable orientation of a tag as it travels in the fluid being pumped through a downhole conduit in the direction of flow indicated by the arrow.

Figure 2:
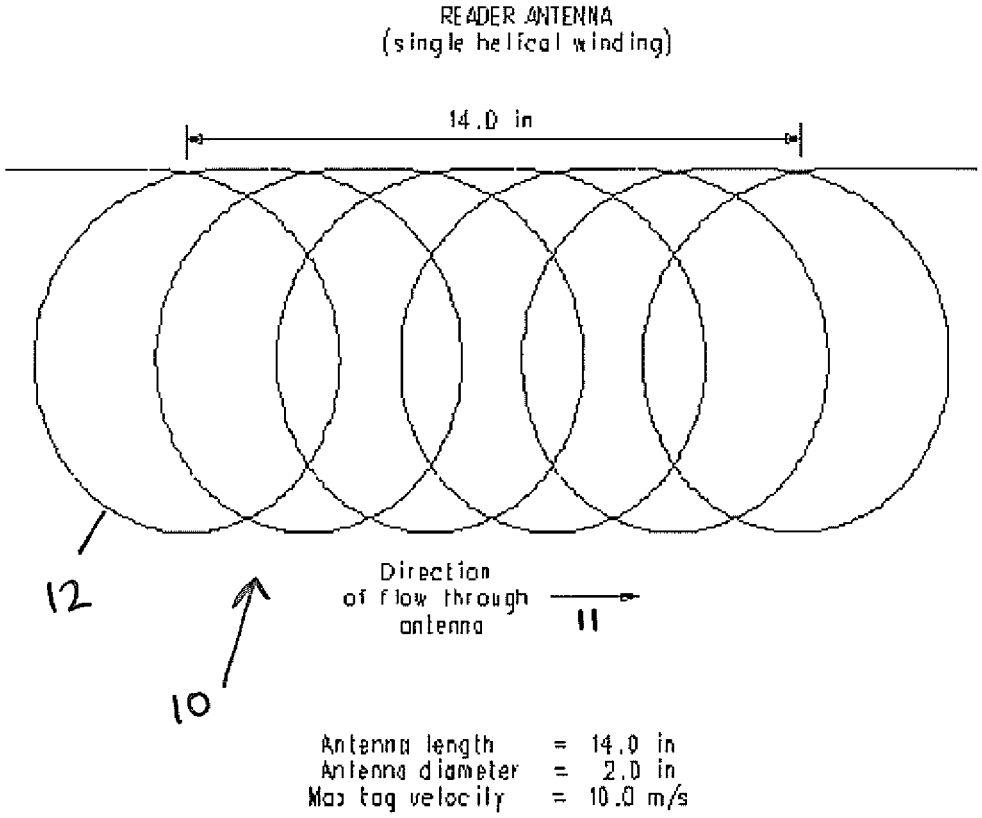
FIG. 2 is a schematic diagram of an RFID tag reader, the reader being for inclusion in a conduit such as a drill string intended for use downhole, with FIG. 2 also showing preferred dimensions of the reader.

A reader in the form of an antenna is shown in FIG. 2 as antenna 10 and is shaped to be incorporated as part of a conduit, such as a drill string, (not shown) in for instance a downhole tool (not shown) having suitable connections (such as OCTG screw threads) for inclusion in the string. The antenna 10 is in the region of 14 inches in length. The antenna 10 comprises an inner liner (not shown) formed from a non-magnetic and non-conductive material such as fibreglass, moulded rubber or the like. The liner has a bore extending longitudinally therethrough. The bore is preferably no narrower than an inner bore of the conduit. The antenna 10 comprises a coiled conductor 12 (typically formed of, for example, a length of copper wire 12) is concentrically wound around the liner in a helical coaxial manner. Insulating material (not shown) formed from fibreglass, rubber or the like separates the coiled conductor from the surrounding housing in the radial direction. The antenna 10 is formed such that the insulating material and coiled conductor are sealed from the outer environment and the inner throughbore.

The two frequencies specified (below) in the present embodiment are optimised for an antenna having a length of around 14 inches (0.356 meters) and a diameter of around 2 inches (0.05 meters) to 4 inches (0.10 meters). A longer antenna provides improved functional results as a tag will take more time to pass through a longer antenna and hence increase the available time for the antenna to charge and read data from the tag. However, a longer antenna is significantly more expensive to manufacture, install and run downhole. Accordingly, an antenna 10 of around 14 inches (0.356 meters) in length balances the cost against the basic functional requirements.

The antenna 10 is coupled to an electronics pack (not shown) and a battery (not shown) to power the assembly prior to being included in the conduit at the surface. The electronics pack is programmed to respond to a specific carrier wave signal having two discrete frequencies.

Figure 1A:
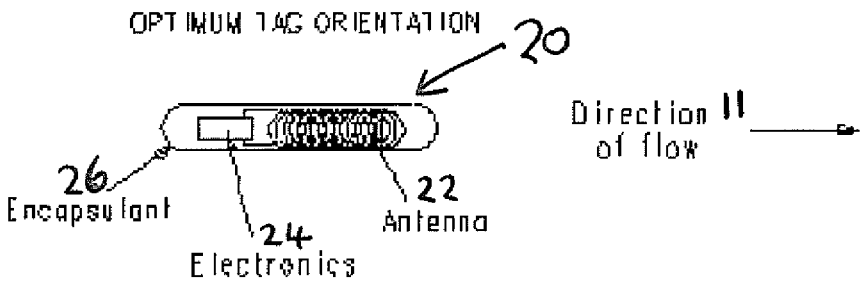
FIG. 1(*a*) is a schematic diagram showing the optimum orientation of a tag as it travels in a fluid flow through a downhole conduit in the direction of the fluid flow indicated by the arrow.
Figure 1B:
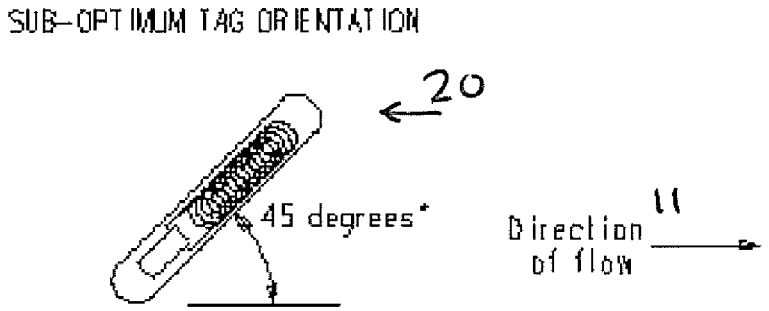
Figure 1C:
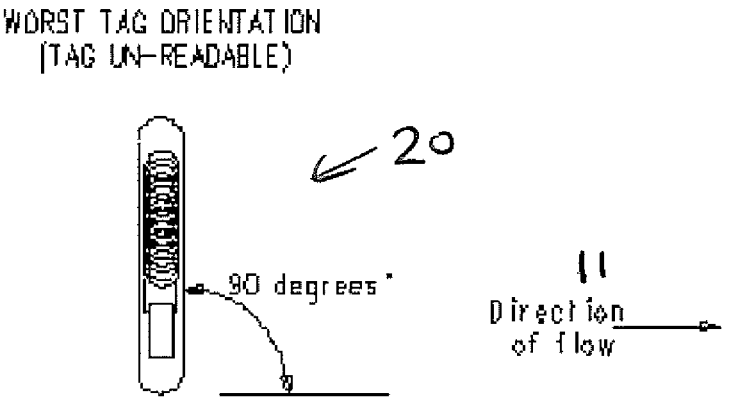

An RFID tag 20 is shown in FIGS. 1(*a*) to 1(*c*) and comprises a miniature electronic circuit having a transceiver chip arranged to receive and store information and a small antenna 22 connected to an electronic circuit 24 within a hermetically sealed casing 26 surrounding the internal components. The RFID tag 20 is capable of withstanding high temperatures and pressures. Glass or ceramic tags 20 are preferable and should be able to withstand 20 000 psi (138 MPa). Oil filled tags 20 are also well suited to use downhole, as they have a good collapse rating.

The RFID tag 20 is programmed to emit a unique signal. The signal emitted by the tag is formed by a carrier wave having two discrete Radio Frequencies (RF); 124 kHz and 134 Hz. The signal transmits binary information. One of the frequencies e.g. 124 kHz represents a "0" and the other frequency e.g. 134 kHz represents a "1".

The two frequencies of the described embodiment are optimally selected. The higher the frequency, the better the signal will carry over a longer range, but the greater the attenuation of the signal, so the harder it may be to detect. Additionally a higher frequency signal requires more energy (battery power) for its detection. Prolonging the battery life of a downhole antenna 10 is a very important consideration, since the battery housed within the antenna 10 cannot be accessed downhole and hence, when there is no further battery power, the downhole antenna 10 will cease to function, until it is removed from the wellbore and the battery replaced.

With a lower frequency signal, there is less attenuation, but the data transmission rate is slower. High data transmission rates are important because the tag 20 passes through the antenna 10 quickly and a high rate of data transmission is required for the antenna 10 to read the signal from the tag 20 before the tag 20 exits the antenna 10.

Thus, the optimum frequencies disclosed herein of 124 kHz and 134 kHz, balance the need to prolong battery life of the antenna 10 and attain the required data transmission rate and signal strength so that the signal is adequately communicated from the tag 20 to the antenna 10 as the tag 20 passes therethrough.

The antenna 10 is made up as part of a drill string and run downhole into the wellbore of a hydrocarbon well along with the drill string. The programmed RFID tag 20 is then weighted, if required, and dropped or flushed into the well with well fluid. After travelling through the inner bore of the conduit, the RFID tag 20 reaches the antenna 10. During passage of the RFID tag 20 through the throughbore of the antenna 10, the antenna 10 charges and reads data from the tag 20. The data is in binary form with both frequencies representing binary information. Data transmitted by the tag 20 is received by the antenna 10 and can then be processed by the electronics pack.

According to one embodiment of the invention, the reader can be coupled to a tool (not shown), such as a circulation sub, flapper valve, packer or the like. In this case, the electronics pack processes data received by the antenna 10 as described above and recognises a flag in the data which corresponds to an actuation instruction data code stored in the electronics pack. The electronics pack can then instruct actuation of the downhole tool.

Several tags 20 programmed with the same operating instructions can be added to the well, so that at least one of the tags 20 will reach the antenna 10 enabling operating instructions to be transmitted. Once the data is transferred, the other RFID tags 20 encoded with similar data can be ignored by the antenna 10.

The tags 20 may also carry data transmitted from the antenna 10, enabling them to be re-coded during passage through the antenna 10. The antenna 10 can emit an RF signal in the form of a carrier wave having two discrete frequencies in response to the RF signal it receives. This can re-code the tag 20 with information sent from the antenna 10. The tag 20 can then be recovered from the cuttings recovered from the annulus from the borehole. In particular, useful data such as temperature, pressure, flow rate and any other operating conditions can be transferred to the tag 20.

According to alternative embodiments of the invention, different frequencies within the frequency range 10 to 200 kHz can be selected. Again the selection of appropriate frequencies depends on factors such as length of the antenna 10 and the required data transmission rates. This method of transmitting digital information using discrete frequency changes of a carrier wave can be referred to as frequency shift keying (hereinafter FSK).

At least two discrete frequencies are required to produce the signal by the carrier wave. The amplitude of the signal is irrelevant since the reader is programmed to identify the difference in frequencies rather than the amplitude or strength of each signal.

Ideally there should be a minimum spacing between the two frequencies to allow the frequencies to be detected without the need to significantly boost the signals downhole. The minimum spacing between the frequencies is particularly important when the downhole conditions are variable, which can affect the signal strength and intensity.

It should be noted that, hitherto, FSK is generally thought not to function as efficiently as ASK for data transmission adjacent large metal bodies. However, the inventors have found that a tag passing downhole through a conduit is typically moving in the region of highest flow rate i.e. towards the centre of the conduit. Therefore the tag 20 emitting the RF signal is not immediately adjacent the metal conduit, although the reader/antenna 10 is positioned immediately adjacent the metal. Furthermore, at the time the tag 20 delivers the RF signal, it is passing through the reader/antenna 10 that has a non-conductive inner liner, rather than the metal conduit itself.

The inventors of the present invention have also realised that the optimum orientation of a tag 20 as it is passing through an antenna 10 in the direction of flow indicated by arrow 11 is as shown in FIG. 1 (*a*); that is with the antenna 22 within tag 20 being coaxial with the conductor coil 12 of the reader/antenna 10 such that the longitudinal axis of the antenna 22 is parallel with the longitudinal axis of the conductor coil 12 of the reader 10. The inventors have also realised that the tag 20 will still be able to be read by the conductor coil 12 of the reader/antenna 10 if it is at a slight angle to the longitudinal axis of the directional flow 11 and therefore the longitudinal axis of the conductor coil 12 of the reader/antenna 10 and this slight angle is shown in FIG. 1 (*b*) as 45 degrees and therefore the slight angle of 45 degrees can be regarded as a sub-optimum tag 20 orientation. However, the inventors of the present invention have also realised that the tag 20 cannot be read by the conductor coil 12 of the reader/antenna 10 if the tag 20 is perpendicular to the direction of flow 11. In other words, the tag 20 cannot be read if its antenna 22 is orientated with its longitudinal axis at 90 degrees to the longitudinal axis of the conductor coil 12 of the reader/antenna 10. Consequently, embodiments of methods in accordance with the present invention will typically include providing a number of tags 20 into the flow of fluid pumped downhole which means that it is statistically unlikely that all of the pumps tags 20 will take on the undesired orientation as shown in FIG. 1(*c*) and that at least a number of the tags 20 will either have the most preferred orientation shown in FIG. 1(*a*) or may have the acceptable orientation (albeit a sub optimum orientation) as shown in FIG. 1 (*b*). In other words, inserting a plurality of tags 20 into the flow of fluid pumped downhole means that it is statistically likely that at least one tag 20 will have its antenna 22 orientated with its longitudinal axis at less than 90 degrees to the longitudinal axis of the conductor coil 12 of the reader/antenna 10 such that it can be read by the reader/antenna 10

FIG. 2 shows that the conductor coil 12 of a preferred reader antenna 10 is 14 inches in length and has a diameter of between 2 and 4 inches. The inventors have discovered that for such an reader/antenna 10, the maximum pumping velocity of the fluid that passes through the reader/antenna 10 should be in the region of 10 meters per second because that is the maximum velocity that the tag 20 can pass through the conductor coil 12 having the dimensions hereinbefore described for there to be sufficient time for the tag 20 to be read and, if necessary, written to.

The inventors have also found the surprising result that RF signals using ASK as a data transmission method can be more difficult than FSK to detect downhole. If a tag 20 emitting signals using ASK is incorrectly located relative to the reader/antenna 10 (for example, the tag 20 is too close to the reader, too far from the reader or the tag 20 is in an incorrect orientation), the reader is not always able to consistently and reliably detect a signal. Since the temperature, pressure, flow rate, direction of flow, etc. in an oil and gas well is varied and can be unpredictable, RF signals based on ASK can be more difficult to detect downhole. As a result, ASK can be useful downhole, but surprisingly has a narrower range of downhole operating parameters than FSK.

Moreover, the inventors have found that there is greater attenuation of ASK signals relying on a change in amplitude compared with FSK that relies on a change in frequency of the carrier wave. This can lead to a poorer signal strength and quality when data is transmitted using ASK.

Modifications and improvements can be made without departing from the scope of the invention.

The invention claimed is:

1. A method of downhole communication comprising the steps of:

(a) programming each tag of a plurality of tags to emit a unique radio frequency identification signal in the form of a frequency change in a carrier wave between at least two discrete frequencies that are in a frequency range between 10 kilohertz and 200 kilohertz, wherein each said tag of the plurality of tags incorporates a first antenna having an axis;

(b) programming a downhole reader to respond to the unique radio frequency identification signal emitted from said each tag of the plurality of tags, and locating the downhole reader in a downhole location, wherein the downhole reader has a second antenna with an axis;

(c) moving said each tag of the plurality of tags past the downhole reader, wherein at least one tag of the plurality of tags is in an orientation with respect to the downhole reader to enable communication of data from said at least one tag to the downhole reader when said at least one tag moves past the downhole reader, and wherein in said orientation of said at least one tag with respect to the downhole reader, the axis of the first antenna in said at least one tag is oriented at an angle that is equal to 45 degrees or less than 45 degrees with respect to the axis of the second antenna in the downhole reader; and (d) communicating the data from said at least one tag to the downhole reader for actuating a downhole tool that is responsive to the data emitted by said at least one tag.

2. The method as claimed in claim 1, further comprising programming said each tag and the downhole reader to communicate the data by at least one of the following:

transitions between discrete frequencies;

use of specific discrete frequencies; and length of time in which the carrier wave emits a specific frequency in preference to at least one other frequency.

3. The method as claimed in claim 1, wherein the at least two discrete frequencies transmit binary information to the downhole reader.

4. The method as claimed in claim 1, wherein the at least two discrete frequencies are selected in the frequency range between 100 and 150 kilohertz.

5. The method as claimed in claim 4, further comprising selecting the carrier wave having two discrete frequencies: 124 kilohertz and 134 kilohertz.

6. The method as claimed in claim 1, further comprising spacing the at least two discrete frequencies by a minimum quantity.

7. The method as claimed in claim 6, further comprising spacing the at least two discrete frequencies by at least 8 kilohertz.

8. The method as claimed in claim 1, further comprising maintaining a constant amplitude of the carrier wave.

9. The method as claimed in claim 1, further comprising programming the downhole reader to transmit data to at least one tag via a radio frequency identification signal in the form of a discrete frequency change in a carrier wave prior to the step (b).

10. The method as claimed in claim 1, wherein the step (b) further comprises associating the downhole reader with a downhole conduit for passage of downhole fluids therethrough.

11. The method as claimed in claim 10, further comprising arranging the downhole reader such that the downhole fluids and said each tag can pass through a throughbore of the downhole conduit and the downhole reader.

12. The method as claimed in claim 10, wherein the downhole conduit comprises a downhole tubing string, the method further comprising matching an inner diameter of the downhole reader and the downhole conduit such that an inner diameter of the downhole conduit is not restricted by the downhole reader.

13. The method as claimed in claim 10, wherein the step (c) further comprises running said each tag in the downhole conduit.

14. The method as claimed in claim 10, further comprising circulating the downhole fluid through the downhole conduit and the downhole reader.

15. The method as claimed in claim 14, wherein step (c) further comprises adding said each tag to the circulating downhole fluid.

16. The method as claimed in claim 15, further comprising circulating said each tag through the downhole reader.

17. The method as claimed in claim 1, wherein the step (c) further comprises charging said each tag as it is moved past the downhole reader.

18. The method as claimed in claim 1, further comprising recovering said each tag after use.

19. The method as claimed in claim 1, further comprising associating the downhole tool with the downhole reader to enable remote actuation of the downhole tool prior to the step (d).

20. The method as claimed in claim 19, wherein the downhole tool is selected from a group consisting of:

sliding sleeves;

packers;

flapper valves; and other tools located in a tubing string.

21. The method as claimed in claim 19, further comprising locating at least two readers in the downhole with associated tools, the at least two readers being individually identifiable or selectable.

22. An apparatus for actuating a downhole tool, the apparatus comprising:

a plurality of tags programmed to emit a unique radio frequency identification signal in the form of a frequency change in a carrier wave between at least two discrete frequencies that are in a frequency range between 10 kilohertz and 200 kilohertz, wherein said each tag of the plurality of tags incorporates a first antenna having an axis;

a downhole reader programmed to respond to the unique radio frequency identification signal emitted from said each tag of the plurality of tags, the downhole reader being adapted for deployment in a downhole location;

wherein the downhole reader has a second antenna with an axis;

wherein said each tag of the plurality of tags is movable past the downhole reader at the said downhole location;

such that at least one tag of the plurality of tags is in an orientation with respect to the downhole reader to enable communication of data from at least one tag to the downhole reader when said at least one tag moves past the downhole reader; and wherein in said orientation of said at least one tag with respect to the downhole reader, the axis of the first antenna in said at least one tag is oriented at an angle that is equal to 45 degrees or less than 45 degrees with respect to the axis of the second antenna in the downhole reader; and wherein the downhole tool is coupled to the downhole reader and wherein the data communicated from said at least one tag to the downhole reader causes actuation of the downhole tool.

23. The apparatus as claimed in claim 22, wherein the second antenna is between 0.1 to 1 meters in axial length.

24. The apparatus as claimed in claim 22, wherein the second antenna has a generally cylindrical housing and a coiled conductor within a portion of the housing, wherein the coiled conductor is separated from the portion of housing by an insulating material, and wherein the portion of the housing has a greater internal diameter than an external diameter of the coiled conductor.

25. The apparatus as claimed in claim 24, wherein the second antenna has a liner, wherein the coiled conductor is wrapped around the liner, in a helical co-axial manner.

26. The apparatus as claimed in claim 25, wherein the housing and the liner form a seal around the coiled conductor and the insulating material.

27. The apparatus as claimed in claim 22, wherein the downhole tool is one of a group consisting of:

sliding sleeves;

packers; flapper valves; and other tools located in a tubing string.

28. The apparatus as claimed in claim 22, wherein said each tag is adapted to withstand temperatures and pressures experienced in the downhole.

29. The apparatus as claimed in claim 22, wherein said each tag is oil-filled.

* * * * *